US006263812B1

(12) United States Patent
Chen

(10) Patent No.: US 6,263,812 B1
(45) Date of Patent: Jul. 24, 2001

(54) LOOPER THREAD TAKE-UP STRUCTURE OF SEWING MACHINE CAPABLE OF VERY EASILY CLEARING UP TANGLING THREAD

(75) Inventor: Shin-Fang Chen, Taipei (TW)

(73) Assignee: Ching Chi Machine Co., Ltd., Taipei Hsien (TW)

( * ) Notice: Subject to any disclaimer, the term of this patent is extended or adjusted under 35 U.S.C. 154(b) by 0 days.

(21) Appl. No.: 09/689,862

(22) Filed: Oct. 13, 2000

(51) Int. Cl.[7] ..... D05B 49/04
(52) U.S. Cl. ..... 112/248
(58) Field of Search ..... 112/248, 249, 112/241, 199

(56) References Cited

U.S. PATENT DOCUMENTS 1,947,333 * 2/1934 Clayton ..... 112/248
2,391,517 * 12/1945 Rubel ..... 112/248
2,895,441 * 7/1959 Engel et al. ..... 112/248
4,633,795 * 1/1987 Von Hagen ..... 112/248
4,917,033 * 4/1990 Satoma ..... 112/199

* cited by examiner

*Primary Examiner*—Ismael Izaguirre
(74) *Attorney, Agent, or Firm*—Rosenberg, Klein & Lee

(57) ABSTRACT

Looper thread take-up structure of sewing machine capable of very easily clearing up tangling thread, including: a rotary shaft; a first and a second take-up cam plates each having a cam outer rim and a non-circular shaft hole, the first and second take-up cam plates being detachably keyed on the rotary shaft; and a spacing ring having a through hole and detachably fitted on the rotary shaft between the first and second take-up cam plates for spacing the same. In case a stitching thread is accidentally tangled on the spacing ring, the first and second take-up cam plates can be separated from each other for quickly and easily clearing up the tangling thread.

8 Claims, 11 Drawing Sheets

LOOPER THREAD TAKE-UP STRUCTURE OF SEWING MACHINE CAPABLE OF VERY EASILY CLEARING UP TANGLING THREAD

BACKGROUND OF THE INVENTION

1. Field of the Invention

The present invention relates to an improved sewing machine, and more particularly to an improved looper thread take-up structure of sewing machine, which is capable of very easily clearing up tangling thread.

2. Description of the Prior Art

In each sewing travel of a conventional sewing machine, the looper thread is taken up once by a take-up mechanism so as to automatically feed the thread and adjust the tightness of the looper thread. FIGS. 1 and 2 show the take-up mechanism which includes a set of take-up cam member 61 and a thread guiding member 62. The looper thread 63 is first passed from a thread reel (not shown) through a thread guiding eye 64 of the thread guiding member 62 and then conducted to a looper (not shown) to cooperate with the upper thread 65 passed through the stitching needle 66 for sewing. Referring to FIG. 3, the take-up cam member 61 is a one-piece member formed of two identically shaped cam plates 67 by burning and welding. The two cam plates 67 are spaced by a wheel rim 68 with smaller diameter to define a cam gap 69 for the thread guiding member 62 to pass there through. By means of the rotation of the take-up cam member 61, the path of the outer rims of the cam plates 67 rotating through the thread guiding member 62 is varied in height so as to take up the stitching thread.

The earlier take-up mechanism is hidden in the base seat (not shown) of the sewing machine and fixed on a lower shaft not shown ). Once the stitching thread is broken, the thread head will be wound and tangled on the rim between the two cam plates during continuous rotation of the take-up cam member. The take-up cam member is fixed in the base seat of the sewing machine so that it is impossible to detach the take-up cam member therefrom. Under such circumstance, it is necessary to use a thin artistic knife to clear up the tangling thread in a very narrow space. This is a task. In order to solve this problem, some manufactures try to mount the take-up mechanism beside the column of the sewing machine instead (as shown in FIGS. 1, 2 and 3 ). However, such improved structure only makes it easier to detach the take-up cam member 61 from the sewing machine. In such structure, the take-up cam plates 67 still form a one-piece member made by burning and welding. After the take-up cam member is detached, it is still very difficult to clear up the tangling thread from the very narrow wheel gap (having a width of only 2 mm ). When the thin artistic knife is extended into the very narrow wheel gap to cut off the tangling thread, it often takes place that the polished outer rim of the take-up cam member is incautiously cut by the sharp blade of the artistic knife. After the take-up cam member is mounted back onto the sewing machine for further operation, the cut formed on the polished outer rim tends to cut off the stitching thread. This leads to a more serious problem of higher ratio of broken thread. Therefore, it is not secure to use the artistic knife for clearing up the tangling thread.

Furthermore, no matter what kind of tool is used to clear up the tangling thread, it is very hard to operate the tool in the very narrow gap for removing the tangling thread. Therefore, it often takes a considerably long time (half day to one day) to clear up the tangling thread. During this period, the machine must be stopped. This greatly affects the production efficiency and results in great trouble in working. Therefore, it is necessary to provide a measure to solve the above problem.

SUMMARY OF THE INVENTION

It is therefore a primary object of the present invention to provide a looper thread take-up structure of sewing machine, which is able to easily and quickly clear up the tangling thread and can be quickly totally installed back onto the sewing machine. (An operator only needs to open the cover and unscrew the screws to quickly separate the two take-up cam plates. Accordingly, the tangling thread can be easily and quickly removed. It only takes several minutes to clear up the tangling thread and totally install the two take-up cam plates back onto the sewing machine for further sewing operation.)

It is a further object of the present invention to provide the above looper thread take-up structure of sewing machine, which has simplified structure and thus can be more easily manufactured.

It is still a further object of the present invention to provide the above looper thread take-up structure of sewing machine, which will not damage the polished outer rim of the take-up cam plates during removal of the tangling thread.

According to the above objects, the looper thread take-up structure of sewing machine of the present invention includes: a rotary shaft; a first take-up cam plate having a cam outer rim and a non-circular shaft hole detachably keyed on the rotary shaft; a second take-up cam plate having a cam outer rim and a non-circular shaft hole detachably keyed on the rotary shaft; and a spacing ring having a through hole and fitted on the rotary shaft between the first and second take-up cam plates for spacing the same, the spacing ring being detachable from the rotary shaft, whereby in case a stitching thread is accidentally tangled on the spacing ring, the first and second take-up cam plates can be separated from each other for easily clearing up the tangling thread.

In the above looper thread take-up structure of sewing machine, the spacing ring can be integrally fixed with the first take-up cam plate.

In the above looper thread take-up structure of sewing machine, the spacing ring can be integrally fixed with the second take-up cam plate.

In the above looper thread take-up structure of sewing machine, the spacing ring, the first take-up cam plate and the second take-up cam plate are independent bodies.

Alternatively, the looper thread take-up structure of sewing machine of the present invention includes: a rotary shaft; a first fixing ring detachably keyed on the rotary shaft, the first fixing ring having a key section; a first take-up cam plate having a cam outer rim and a non-circular shaft hole detachably fitted with the key section of the first fixing ring; a second take-up cam plate having a cam outer rim and a non-circular shaft hole detachably fitted with the key section of the first fixing ring; a spacing ring having a through hole and fitted on the first fixing ring between the first and second take-up cam plates for spacing the same, the spacing ring being detachable from the first fixing ring; and a second fixing ring attached the second take-up cam plate to integrally lock the first take-up cam plate, the spacing ring and the second take-up cam plate with the first fixing ring, whereby in case a stitching thread is accidentally tangled on the spacing ring, the first and second take-up cam plates can be separated from each other for easily clearing up the tangling thread.

In the above looper thread take-up structure of sewing machine, the spacing ring can be integrally fixed with the first take-up cam plate.

In the above looper thread take-up structure of sewing machine, the spacing ring can be integrally fixed with the second take-up cam plate.

In the above looper thread take-up structure of sewing machine, the spacing ring, the first take-up cam plate and the second take-up cam plate are independent bodies.

The present invention can be best understood through the following description and accompanying drawings wherein:

DETAILED DESCRIPTION OF THE PREFERRED EMBODIMENTS

Figure 11:
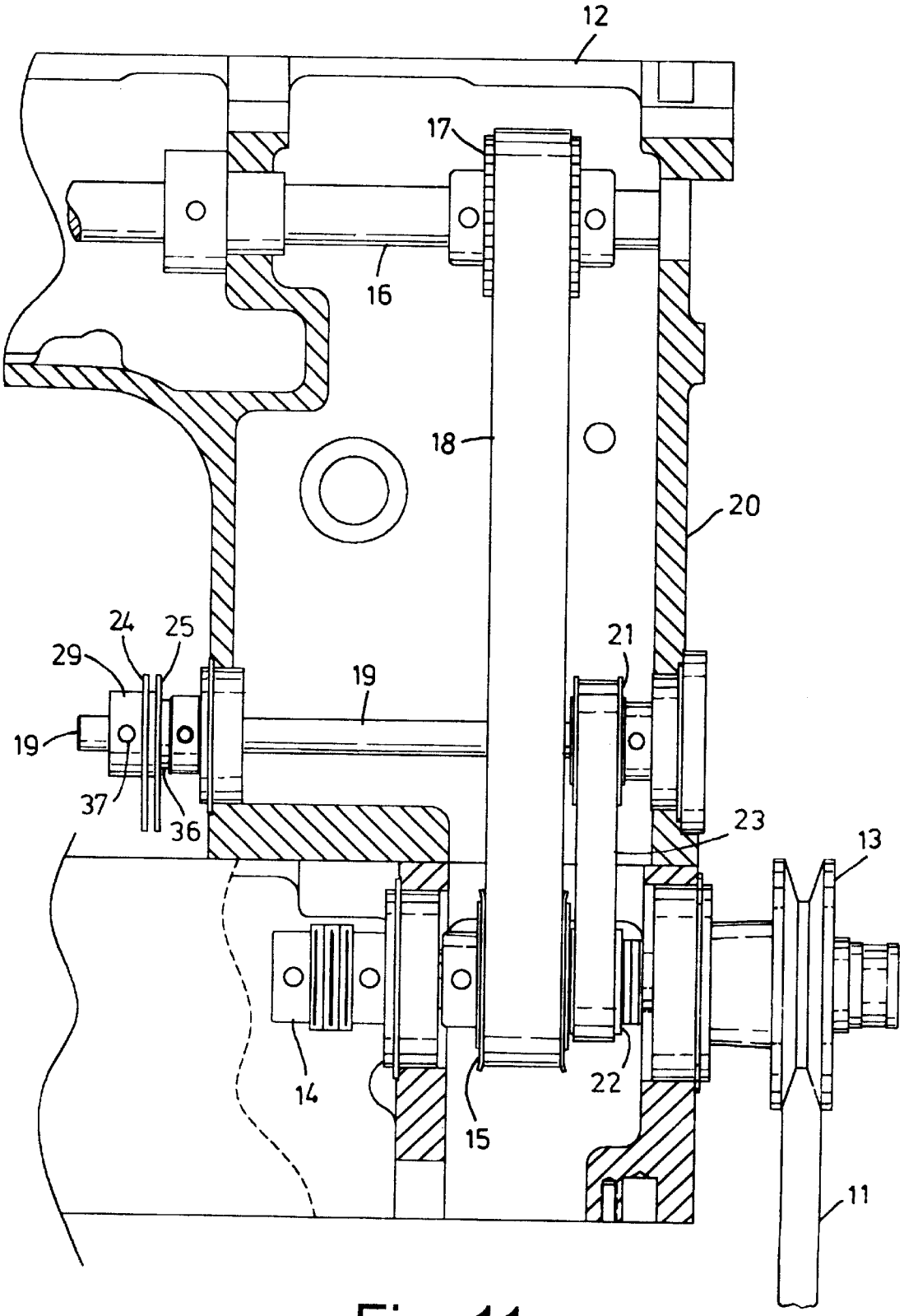
FIG. 11 is a sectional view taken along line 11—11 of FIG. 9.
Figure 12:
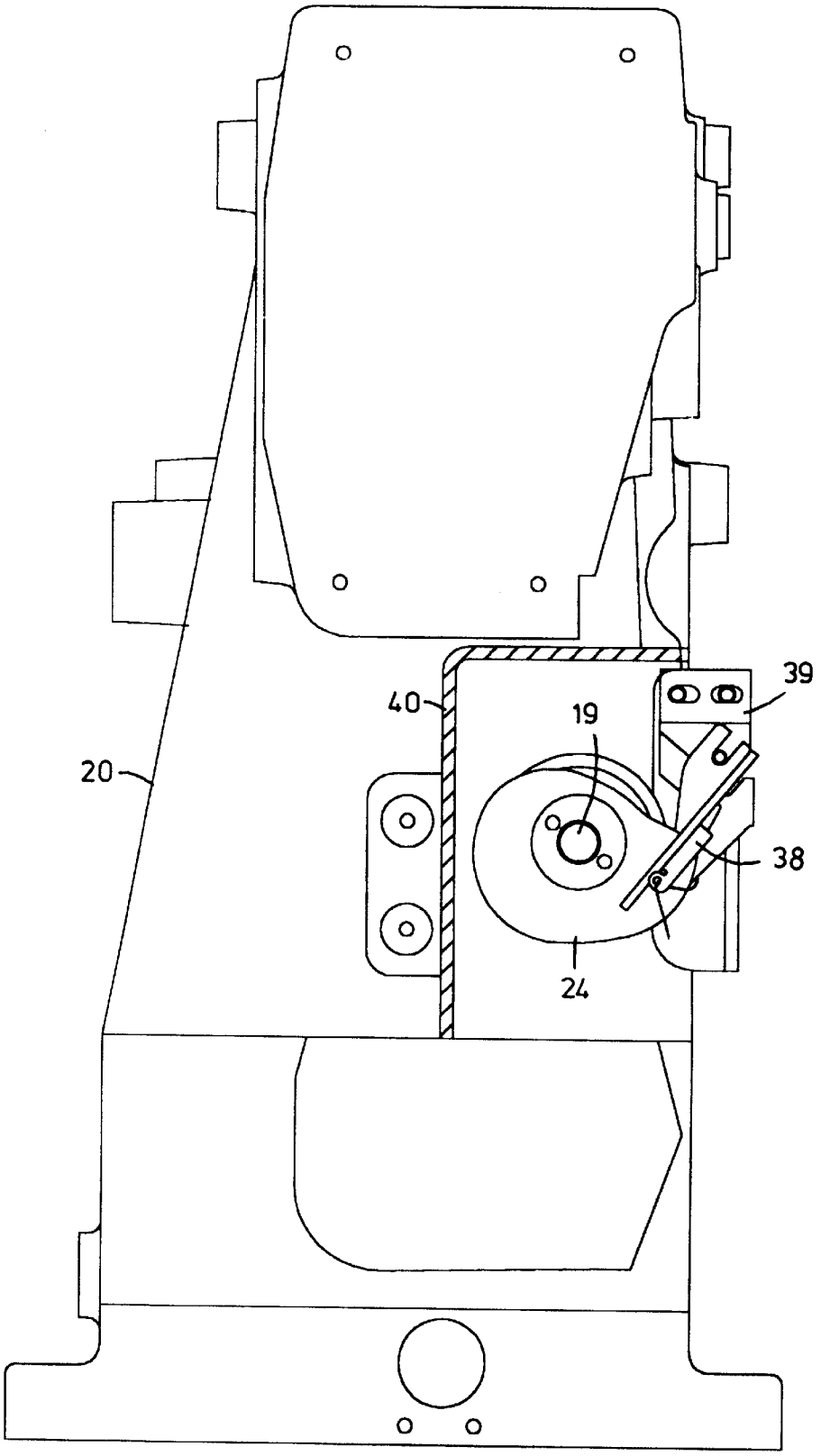
FIG. 12 is a left view showing that the present invention is installed on a sewing machine and operated in one state.
Figure 13:
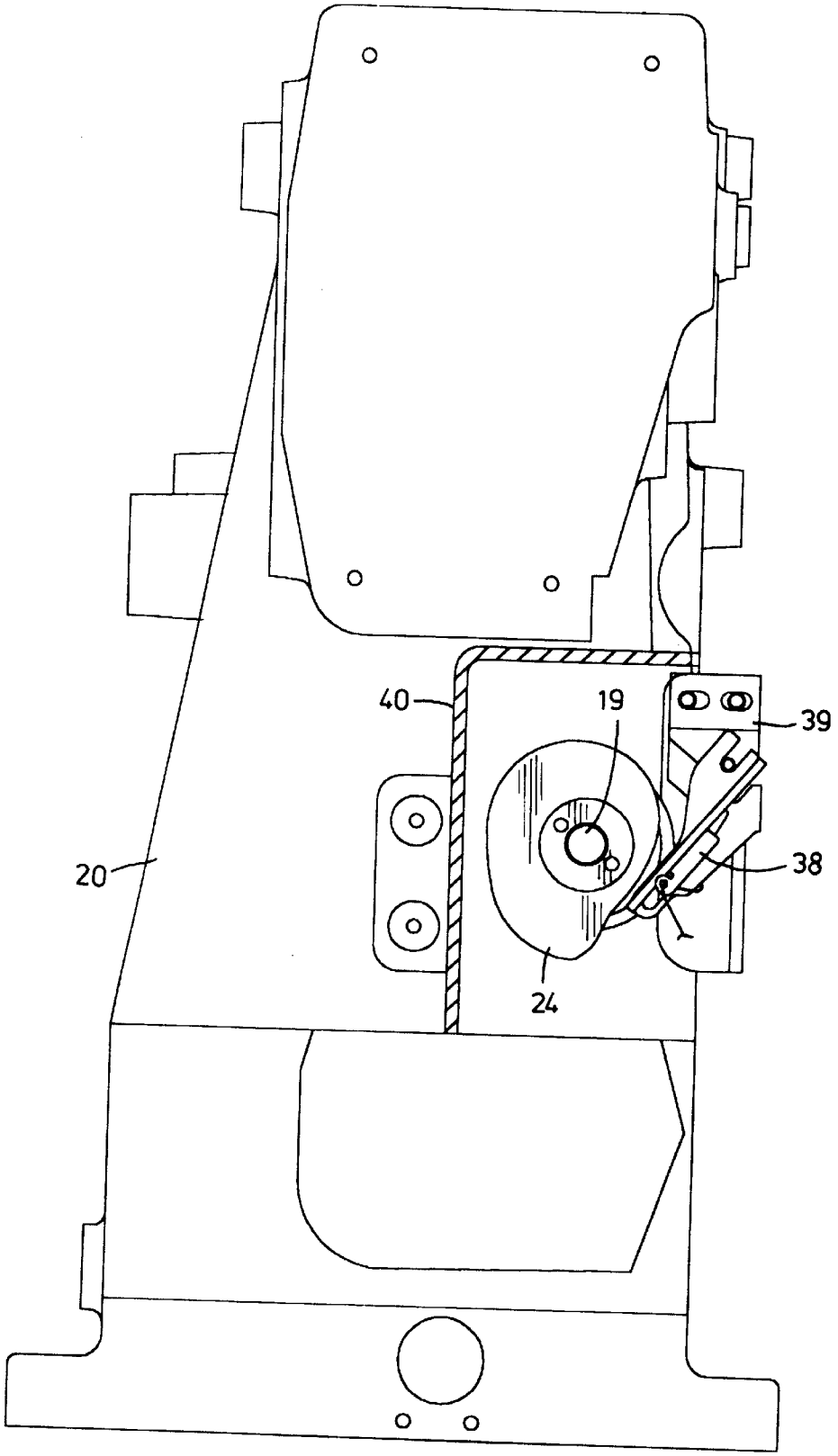
FIG. 13 is a left view showing that the present invention installed on a sewing machine and operated in another state.

Please refer to FIG. 11. A motor (not shown) outputs power which is transmitted by a belt 11 to drive a pulley 13 mounted on outer side of a housing 12 of the sewing machine. The pulley 13 further drives a lower shaft 14 to rotate. A timing pulley 15 (toothed pulley) is installed on the lower shaft 14. Another timing pulley 17 is installed on the upper shaft 16 of the sewing machine. A timing belt 18 (toothed belt) is wound between the timing pulleys 15, 17 of the lower and upper shafts 14, 16, whereby the upper and lower shafts 16, 14 can be synchronously rotated. The above structure pertains to conventional structure of a sewing machine.

Further referring to FIG. 11, a rotary shaft 19 is additionally mounted between the upper and lower shafts 16, 14. The rotary shaft 19 is disposed at the column 20 of the housing 12 of the sewing machine with left end extending out of the column 20. In addition, a timing pulley 21 is mounted on the rotary shaft 19 and a timing pulley 22 is additionally mounted on the lower shaft 14. A timing belt 23 is wound between the two timing pulleys 21, 22. Accordingly, the lower shaft 14 can sequentially via the timing pulley 22, timing belt 23 and the timing pulley 21 drive the rotary shaft 19 to rotate. The looper thread take-up structure 10 of the present invention is installed on the rotary shaft 19 and driven thereby.

Figure 1:
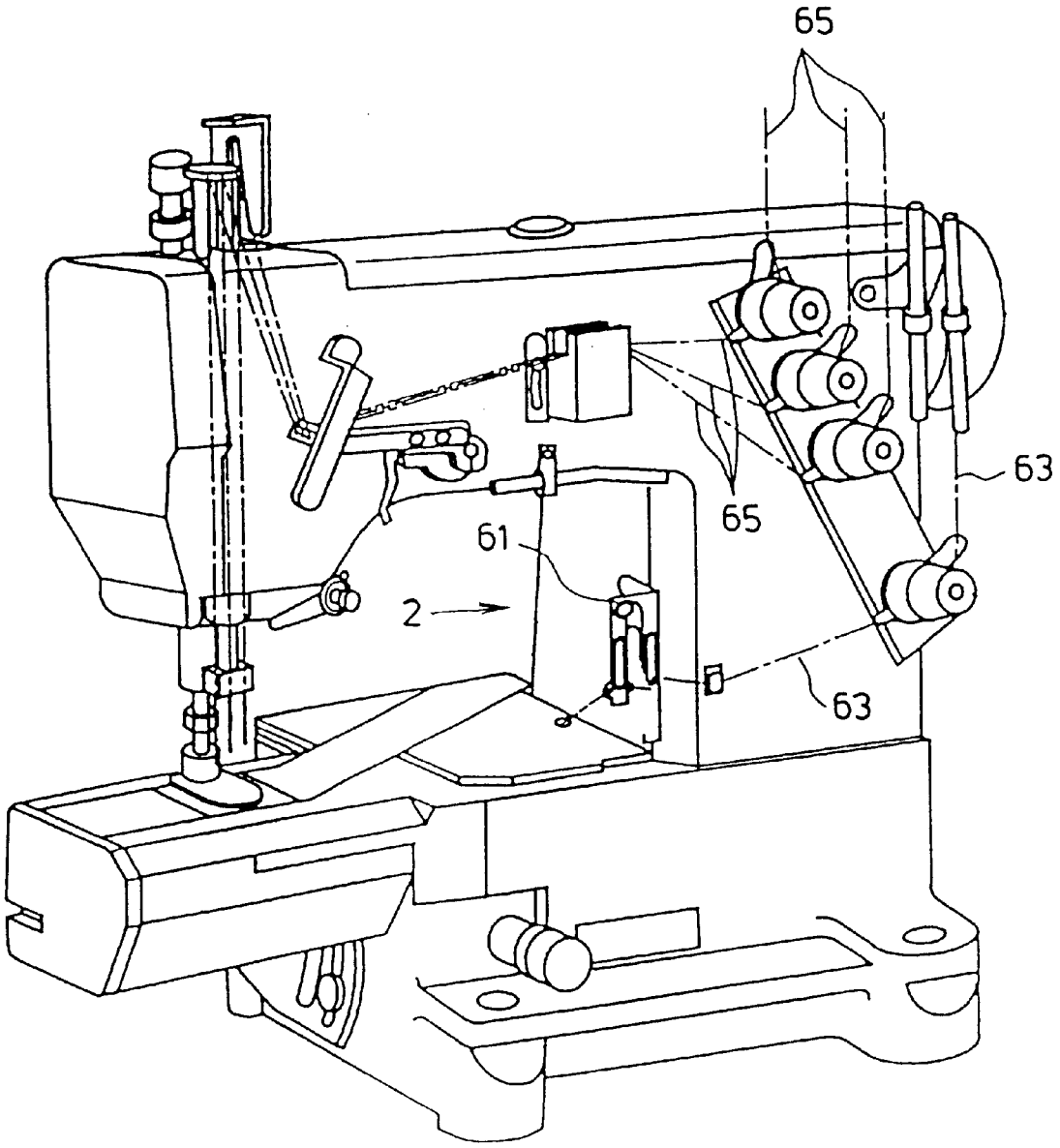
Fig. 1 PRIOR ART
FIG. 1 is a perspective view of a conventional sewing machine.
Figure 2:
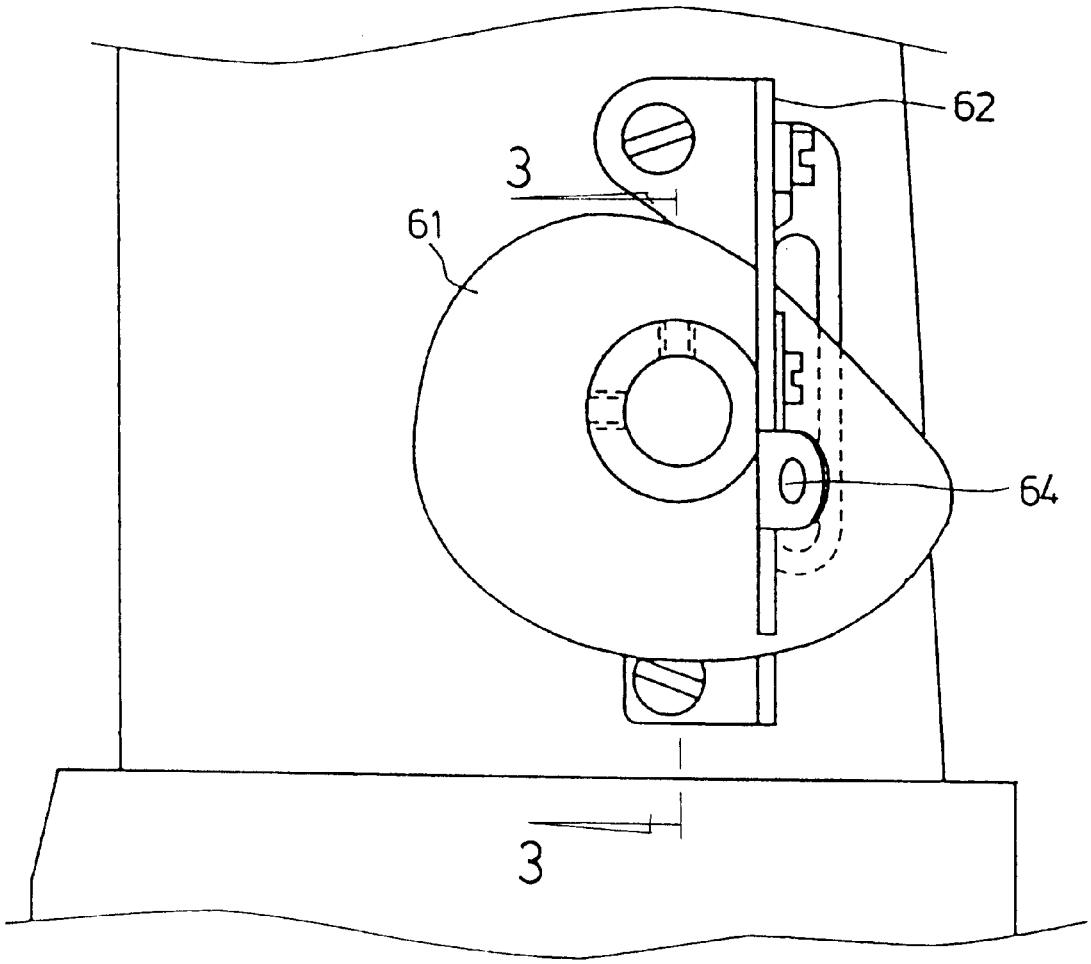
Fig. 2 PRIOR ART
FIG. 2 is an enlarged view of a part of FIG. 1 indicated by arrow 1.
Figure 3:
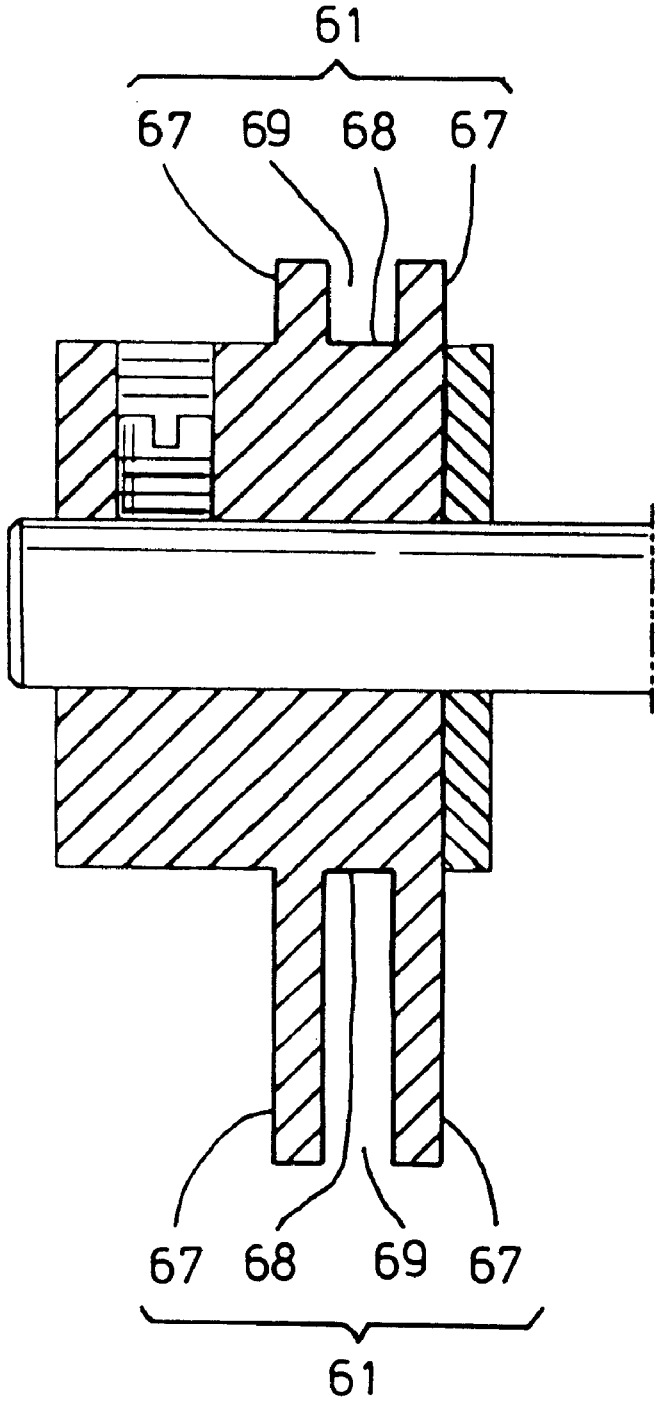
Fig.3 PRIOR ART
FIG. 3 is a sectional view taken along line 3—3 of FIG. 2.
Figure 4:
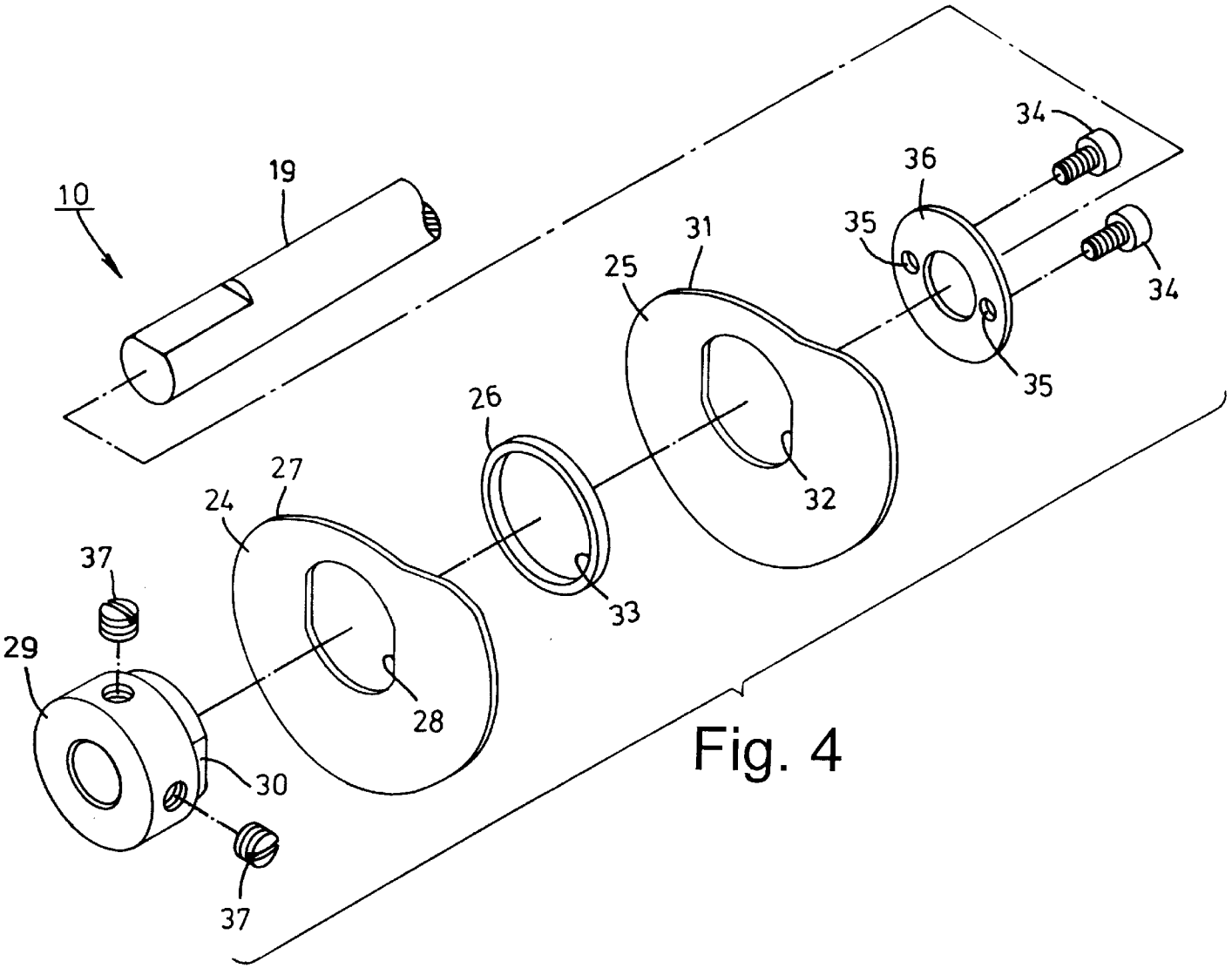
FIG. 4 is a perspective exploded view of the present invention.
Figure 5:
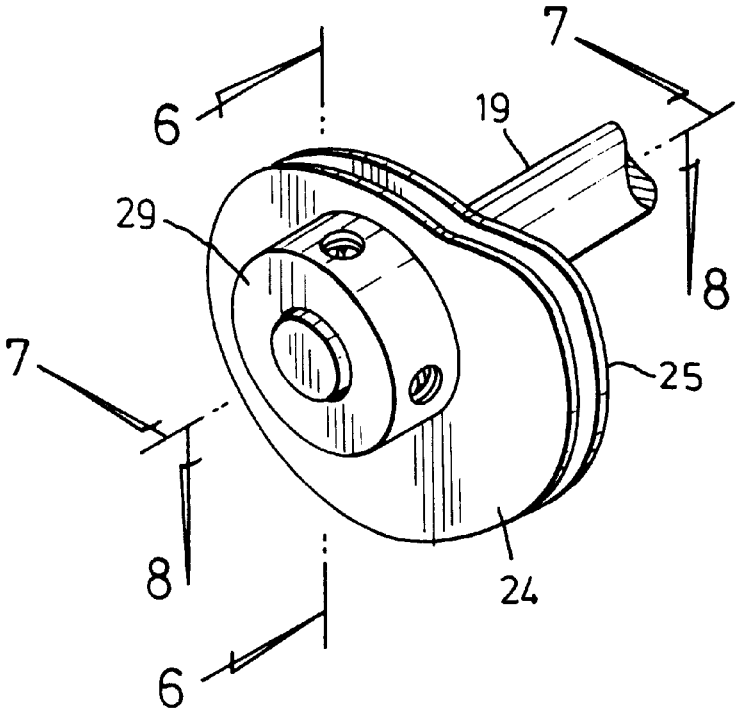
FIG. 5 is a perspective assembled view of the present invention.
Figure 6:
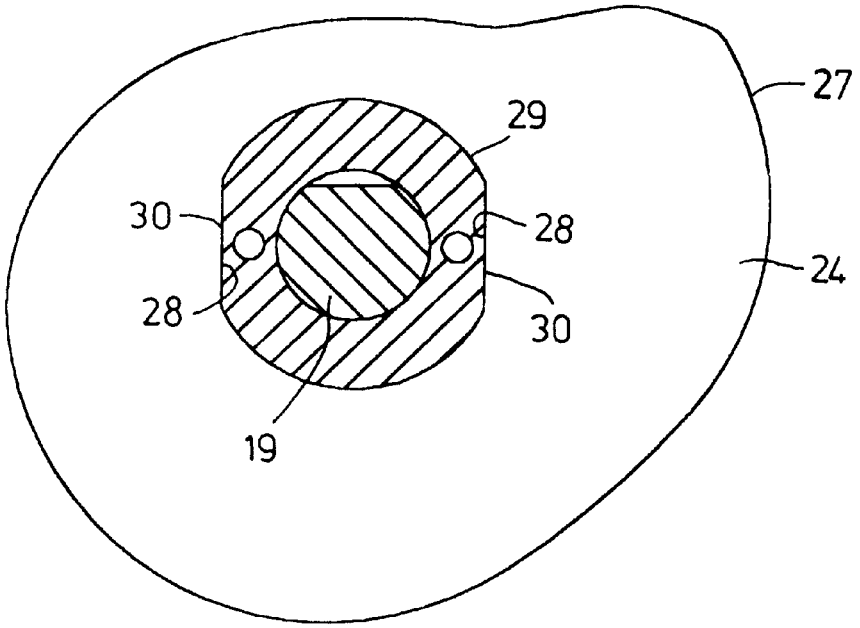
FIG. 6 is a sectional view taken along line 6—6 of FIG. 5.
Figure 7:
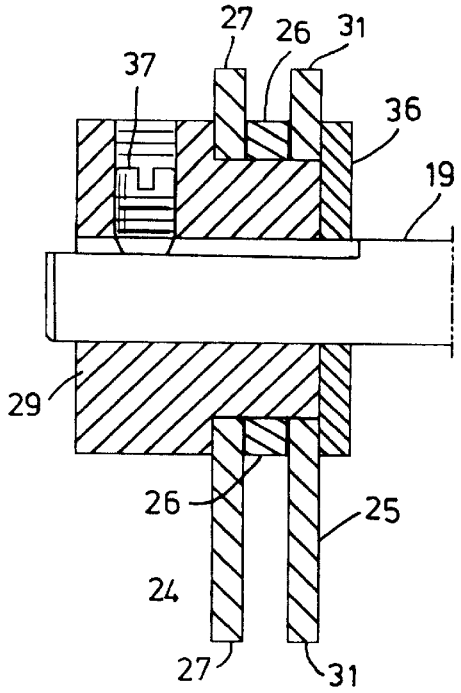
FIG. 7 is a sectional view taken along line 7—7 of FIG. 5.
Figure 8:
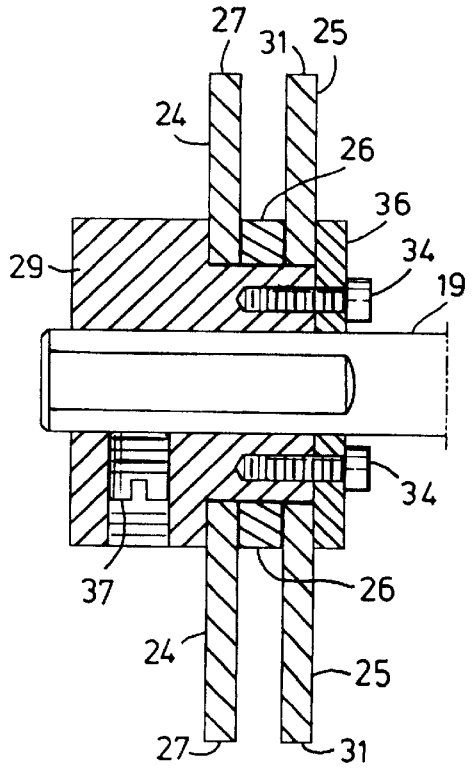
FIG. 8 is a sectional view taken along line 8—8 of FIG. 5.
Figure 9:
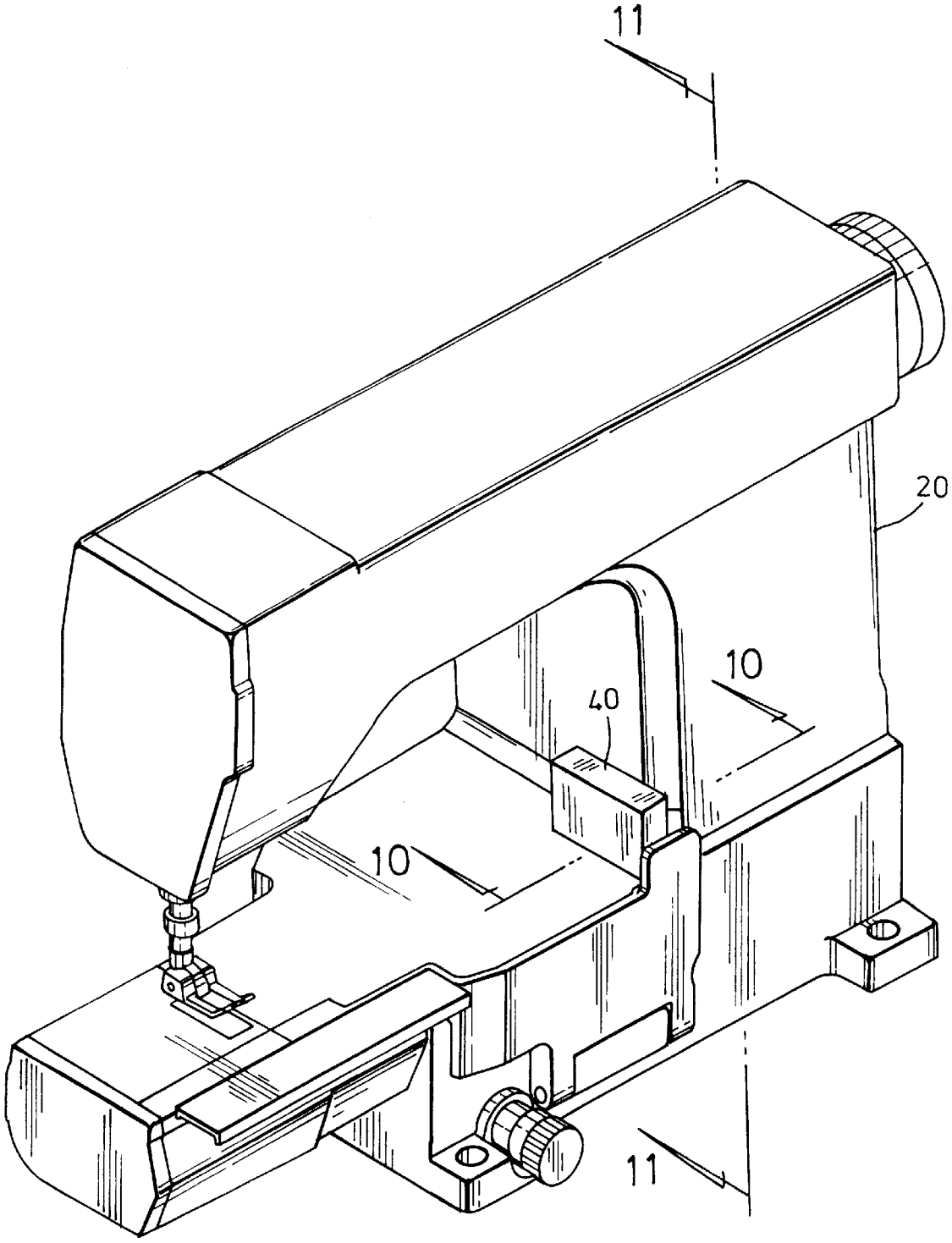
FIG. 9 is a perspective view showing that the present invention is installed on a sewing machine.
Figure 10:
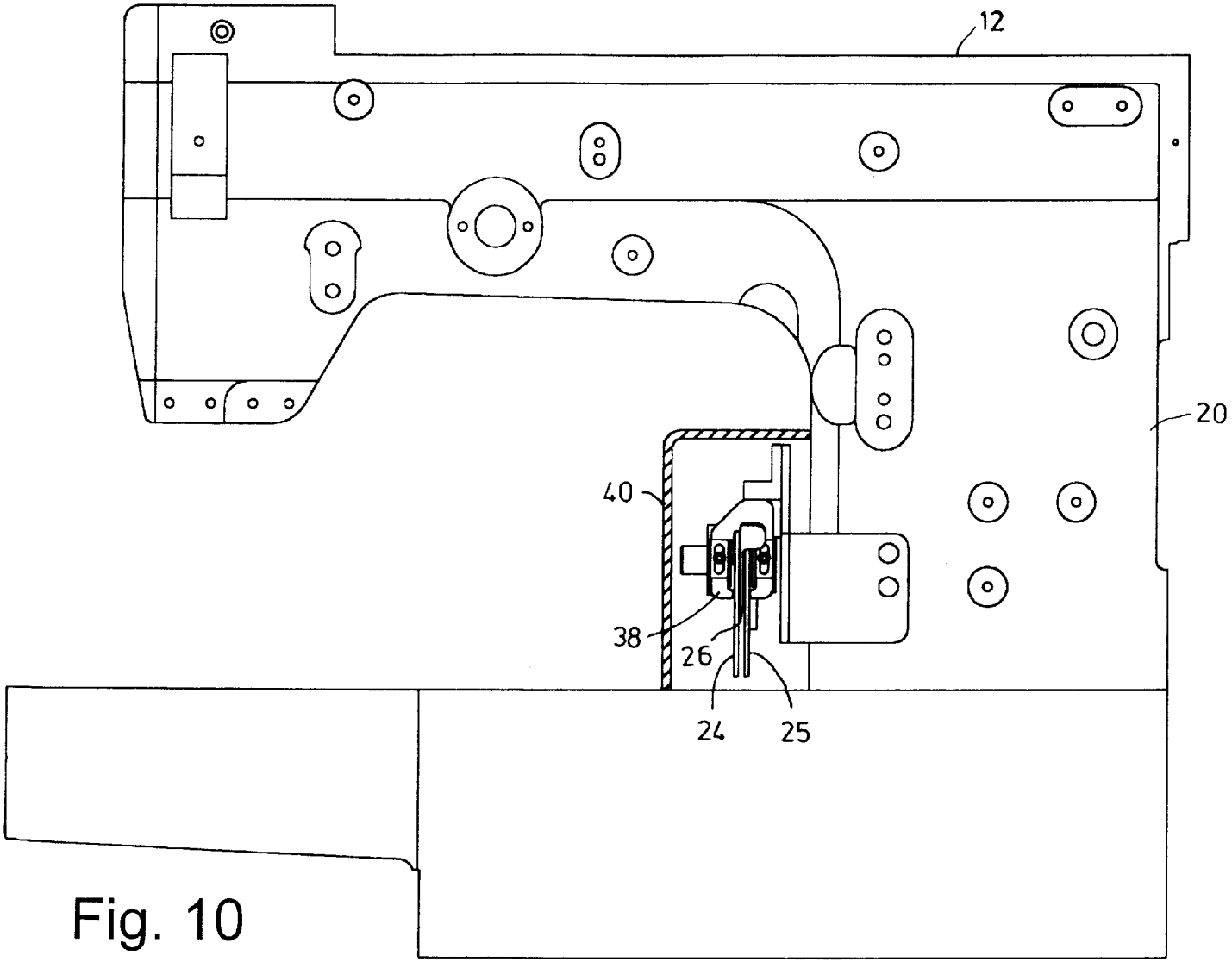
FIG. 10 is a sectional view taken along line 10—10 of FIG. 9.

Please refer to FIG. 4. The looper thread take-up structure 10 of the present invention includes a rotary shaft 19, a first take-up cam plate 24, a second take-up cam plate 25 and a spacing ring 26.

The first take-up cam plate 24 has a cam outer rim 27 and a non-circular shaft hole 28 fitted with a key section 30 of a first fixing ring 29. The first take-up cam plate 24 can be detached from the first fixing ring 29. The second take-up cam plate 25 has a cam outer rim 31 and a non-circular shaft hole 32 detachably fitted with a key section 30 of a first fixing ring 29. The spacing ring 26 has a through hole 33 and is fitted on the first fixing ring 29 between the first and second take-up cam plates 24, 25 for spacing the same. The spacing ring 26 can be detached from the first fixing ring 29. In case the stitching thread is accidentally tangled on the spacing ring 26, the first and second take-up cam plates 24, 25 can be separated from each other for easily clearing up the tangling thread.

Referring to FIGS. 4 to 8, when assembled, the first take-up cam plate 24, the spacing ring 26 and the second take-up cam plate 25 are sequentially fitted onto the first fixing ring 29 with the key section 30 thereof fitted in the non-circular shaft holes 28, 32 of the first and second take-up cam plates 24, 25. Then screws 34 are screwed into the thread holes 35 of the second fixing ring 36, the shaft hole 32 of the second take-up cam plate 25, the through hole 33 of the spacing ring 26 and the shaft hole 28 of the first take-up cam plate 24 so as to lock the second fixing ring 36 with the first fixing ring 29. Therefore, the first take-up cam plate 24, the spacing ring 26, the second take-up cam plate 25, the first fixing ring 29 and the second fixing ring 36 are locked together. Then the locked first take-up cam plate 24, the spacing ring 26, the second take-up cam plate 25, the first fixing ring 29 and the second fixing ring 36 are locked on the rotary shaft 19 by screws 37. Accordingly, the first take-up cam plate 24, the spacing ring 26 and the second take-up cam plate 25 are not only locked together, but also they are fixed at the left end of the rotary shaft 19 to rotate along therewith. Then the conventional thread guiding member 38 is locked on a supporting rack 39.

According to the above arrangement, the first take-up cam plate 24, the second take-up cam plate 25 and the spacing ring 26 are independent bodies which are detachably locked together.

Please refer to FIGS. 4 to 13. In case the stitching thread is incautiously tangled on the spacing ring 26, a cover 40 is opened (as shown in FIGS. 9, 10, 12, 13) and the thread guiding member 38 is removed. The screws 37 at the left end are unscrewed as shown in FIGS. 4 to 8 so as to take away the locked first take-up cam plate 24, the spacing ring 26, the second take-up cam plate 25, the first fixing ring 29 and the second fixing ring 36. Then the screws 34 are unscrewed and the leftmost first take-up cam plate 24 and the spacing ring 26 are sequentially detached. At this time, the thread tangling on the outer rim of the spacing ring 26 can be very easily removed. Then the components can be quickly re-assembled by a reverse procedure for further sewing operation. It only takes several minutes to complete such procedure. Therefore, the tangling thread can be very easily removed.

According to the above arrangement, the looper thread take-up structure of sewing machine capable of very easily clearing up tangling thread of the present invention has the following advantages:

1. The looper thread take-up structure of the present invention is able to easily and quickly clear up the tangling thread and can be quickly totally installed back onto the sewing machine. (An operator only needs to open the cover and unscrew the screws to quickly separate the two take-up cam plates 24, 25. Accordingly, the tangling thread can be easily and quickly removed. It only takes several minutes to clear up the tangling thread and totally install the two take-up cam plates 24, 25 back onto the sewing machine for further sewing operation.

2. The looper thread take-up structure of the present invention has simplified structure and thus can be more easily manufactured.

3. When clearing up the tangling thread, the looper thread take-up structure of the present invention will not damage the polished outer rim of the take-up cam plates.

The above embodiments are only used to illustrate the present invention, not intended to limit the scope thereof. Many modifications of the above embodiments can be made without departing from the spirit of the present invention.

What is claimed is:

1. Looper thread take-up structure of sewing machine capable of very easily clearing up tangling thread, comprising:

(a) a rotary shaft; a first take-up cam plate having a cam outer rim and a non-circular shaft hole detachably keyed on the rotary shaft;

(b) a second take-up cam plate having a cam outer rim and a non-circular shaft hole detachably keyed on the rotary shaft; and (c) a spacing ring having a through hole and fitted on the rotary shaft between the first and second take-up cam plates for spacing the same, the spacing ring being detachable from the rotary shaft, whereby in case a stitching thread is accidentally tangled on the spacing ring, the first and second take-up cam plates can be separated from each other for easily clearing up the tangling thread.

2. Looper thread take-up structure of sewing machine as claimed in claim 1, wherein the spacing ring is integrally fixed with the first take-up cam plate.

3. Looper thread take-up structure of sewing machine as claimed in claim 1, wherein the spacing ring is integrally fixed with the second take-up cam plate.

4. Looper thread take-up structure of sewing machine as claimed in claim 1, wherein the spacing ring, the first take-up cam plate and the second take-up cam plate are independent bodies.

5. Looper thread take-up structure of sewing machine capable of very easily clearing up tangling thread, comprising a rotary shaft; a first fixing ring detachably keyed on the rotary shaft, the first fixing ring having a key section; a first take-up cam plate having a cam outer rim and a non-circular shaft hole detachably fitted with the key section of the first fixing ring; a second take-up cam plate having a cam outer rim and a non-circular shaft hole detachably fitted with the key section of the first fixing ring; a spacing ring having a through hole and fitted on the first fixing ring between the first and second take-up cam plates for spacing the same, the spacing ring being detachable from the first fixing ring; and a second fixing ring attached the second take-up cam plate to integrally lock the first take-up cam plate, the spacing ring and the second take-up cam plate with the first fixing ring, whereby in case a stitching thread is accidentally tangled on the spacing ring, the first and second take-up cam plates can be separated from each other for easily clearing up the tangling thread.

6. Looper thread take-up structure of sewing machine as claimed in claim 5, wherein the spacing ring is integrally fixed with the first take-up cam plate.

7. Looper thread take-up structure of sewing machine as claimed in claim 5, wherein the spacing ring is integrally fixed with the second take-up cam plate.

8. Looper thread take-up structure of sewing machine as claimed in claim 5, wherein the spacing ring, the first take-up cam plate and the second take-up cam plate are independent bodies.

* * * * *